United States Patent [19]

Koffron

[11] Patent Number: 4,601,415

[45] Date of Patent: Jul. 22, 1986

[54] VORTEX INHIBITOR FOR MOLTEN METAL DISCHARGE

[76] Inventor: Robert J. Koffron, 31269 Verona Dr., Farmington Hills, Mich. 48018

[21] Appl. No.: 652,664

[22] Filed: Sep. 21, 1984

[51] Int. Cl.[4] ..... B22D 41/10

[52] U.S. Cl. ..... 222/597; 222/591; 266/45; 266/272; 266/227; 266/230

[58] Field of Search ..... 222/590, 591, 597; 266/227, 228, 230, 45, 272

[56] References Cited

U.S. PATENT DOCUMENTS

| | | | |
|---|---|---|---|
| 2,718,389 | 9/1955 | Perrin | 266/230 |
| 2,810,169 | 10/1957 | Hofer | 222/591 |
| 3,814,407 | 6/1974 | Meyers | 266/230 |
| 3,934,755 | 1/1976 | Rheinlander et al. | 222/590 |
| 4,095,777 | 6/1978 | Honaker | 266/271 |
| 4,390,170 | 6/1983 | Schaefer, IV et al. | 266/271 |
| 4,462,574 | 7/1984 | Keenan et al. | 266/230 |
| 4,494,734 | 1/1985 | LaBate et al. | 266/230 |
| 4,526,349 | 7/1985 | Schwer | 266/227 |

FOREIGN PATENT DOCUMENTS

| | | | |
|---|---|---|---|
| 0286132 | 7/1915 | Fed. Rep. of Germany | 222/590 |
| 1063860 | 12/1953 | France | 222/597 |
| 7022602 | 6/1977 | Japan | 266/227 |
| 9047314 | 3/1984 | Japan | 266/230 |

*Primary Examiner*—Joseph J. Rolla
*Assistant Examiner*—Louise S. Heim
*Attorney, Agent, or Firm*—Brooks & Kushman

[57] ABSTRACT

A vortex inhibitor for use in tundishes, ladles, or metal making furnaces prevents the contamination of high quality molten steel by the slag layer which rides atop the surface of molten metal within such receptacles comprises a tapered polygonal body of castable refractory material whose specific gravity is less than the specific gravity of the molten metal but greater than the specific gravity of the slag. The refractory body is buoyantly supported at the interface of the layer of slag and the molten metal and includes a weighted apex so that the apex depends toward nozzle opening within receptacle. Thus, the body centers itself within the swirl of fluid generated during discharge of the fluid through the nozzle, and the inertia of the body substantially deenergizes the vortex so as to avoid formation of a suction funnel which typically draws the slag layer into and through the nozzle with the molten metal below the previously known critical level within the receptacle.

15 Claims, 5 Drawing Figures

VORTEX INHIBITOR FOR MOLTEN METAL DISCHARGE

BACKGROUND OF THE INVENTION

I. Field of the Present Invention

The present invention relates generally to metal making apparatus, and more particularly to apparatus for separating slag from molten metal as the molten metal is transferred from a receptacle.

II. Description of the Prior Art

In metal making processes, such as steel making, a layer of slag comprising metal impurities lies atop the surface of the molten metal held within a receptacle. When the molten metal is drained from the receptacle, it is important to maintain the separation between the slag and molten metal so that the high quality steel being discharged is not contaminated by the slag. For example, in the formation of a continuous, steel strand, a receptacle known as a tundish receives molten metal from numerous ladles for distribution to the strand making mold through a single discharge nozzle. The nozzle is located in the bottom wall of the tundish so that the nozzle is in fluid contact only with the layer of molten metal in the tundish and is separated from the slag at the top surface of the molten metal.

However, in a previously known tundish, the flow of molten metal through the discharge nozzle causes a vortex which introduces a swirl to the molten metal within the tundish above the discharge nozzle. When the tundish is filled to a high level, the minor swirl imparted to the fluid does not affect the separation between the slag layer and the steel layer. However, when the fluid level reaches a certain depth, hereinafter referred to as the critical level, which is dependent upon the size of the discharge nozzle, the vortex forms a funnel which sucks the slag layer down through the center of the vortex and into the discharge nozzle along with the high quality molten metal. At this point, the quality of the strand being formed is substantially affected by contamination of the slag. As a result, it has heretofore been necessary to halt the strand formation and begin the formation of a reduced quality product or permit the metal to harden in the tundish for subsequent remelting when the level of metal can be raised above the critical level.

Unfortunately, the level of fluid at which the vortex suction effect occurs is relatively high, whereby a substantial amount of high quality molten metal remains trapped within the tundish. As a result, substantially less high quality metal is available for strand forming than has actually been produced. Moreover, substantial energy input is required to reheat metal which has hardened within the tundish.

Furthermore, even if the strand forming process is changed in order to form strands of substantially lower quality steel, it has heretofore been difficult to detect or sense when the level of molten metal is at the critical level in the tundish. Since the suction action of the vortex draws the slag into the center of the vortex, a person operating the tundish cannot see that slag is flowing through the nozzle since molten metal surrounds the slag as it passes through the nozzle. Rather, the surfacing of slag in the strand mold has heretofore provided an indication that the critical level has been reached, but such an indication occurs only after contamination of the high quality steel strand.

SUMMARY OF THE PRESENT INVENTION

The present invention overcomes the above mentioned disadvantages by providing a refractory body adapted to inhibit the vortex effect and permit substantially more high quality molten metal to be poured from a tundish or other receptacle without the intermixture of slag. The body generally comprises a tapered, polygonal body having means for supporting the body at the interface of the layer of slag and molten metal to inhibit the suction effect which occurs when the vortex is formed at the critical level. In particular, it appears that such a body extracts sufficient energy from the vortex to avoid the formation of a suction affect funnel and prevents intermixture of the slag and the molten metal. In addition, the apex of the tapered body is oriented directly downward toward the discharge nozzle so that as the apex approaches and begins to enter the nozzle opening, a throttling effect is initiated to provide a means for detecting that the level of slag is approaching the nozzle.

In the preferred embodiment, a tetrahedral body is formed of a castable refractory and includes a weighted core embedded in the body so that the center of gravity is shifted toward an apex. The body has a specfic gravity less than the specific gravity of the molten metal and greater than the specific gravity of the slag so that the body is buoyantly supported at the interface of the layer of slag and the layer of molten metal. Moreover, the core, preferably a steel or iron sphere, acts as a weighting means for orienting an apex of the tetrahedral body downward so that the shape of the body generally conforms with the shape of the vortex which would naturally occur above the discharge nozzle, and so that the throttling effect can be generated at the nozzle to signal a slag level substantially near the discharge nozzle.

Since the shape of the body generally conforms with the shape of the vortex normally formed above the discharge nozzle, it naturally tends to center itself within the vortex so that it need not be controlled by external means. Moreover, since the specific gravity of the body is adjusted to buoyantly support the body at the interface of the layer of slag and the layer of molten metal, there is no need for external supports for the body.

Thus the present invention permits the tundish to be operated more efficiently since molten metal can be drained through the discharge nozzle at a maximum rate below the previously known critical level. As a result, it is not necessary to change the operation to a low quality production run, or to shut down the tundish altogether and allow the remaining metal to harden until it can be remelted for use with an additional supply of molten metal. Moreover, the present invention provides a throttling means for providing a perceptible or otherwise detectable indication that the supply of molten metal in the tundish is nearly exhausted. Moreover, the present invention permits substantially complete drainage of the tundish without intermixture of the slag and molten metal layers. As a result, it will be understood that the device is can also be used for other molten metal receptacles, such as ladles and furnaces, in which separation of the slag from molten metal must be maintained while the metal is discharged from the receptacle.

BRIEF DESCRIPTION OF THE DRAWING

The present invention will be more clearly understood by reference to the following detailed description of the preferred embodiment of the present invention when read in conjunction with the accompanying drawing in which like reference characters refer to like parts throughout the views and in which.

DETAILED DESCRIPTION OF A PREFERRED EMBODIMENT OF THE PRESENT INVENTION

Figure 1:
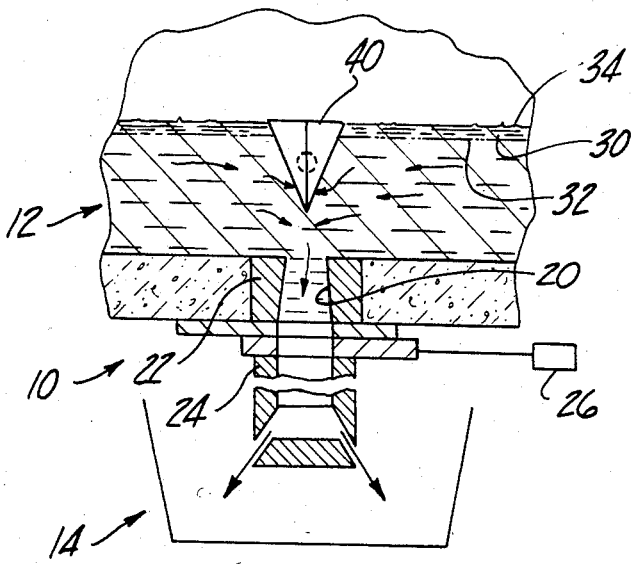
FIG. 1 is a sectional view of a tundish employing a vortex inhibitor of the present invention.

Referring first to FIG. 1, a molten metal processing apparatus 10 is thereshown comprising a tundish 12 and a strand mold 14. The tundish 12 includes an open-topped housing 16 having a bottom wall 18. The bottom wall 18 includes an upper collector nozzle 20 formed in a sleeve 22 secured within the wall 18. The upper collector nozzle 20 registers with a submerged entry nozzle 24 which directs fluid, i.e. molten metal, into the strand mold 14 for the formation of a continously cast elongated metal strand. A control means 26, diagrammatically shown in FIG. 1, controls the passage of metal into the strand mold 14.

As also shown diagrammatically in FIG. 1, the tundish 12 contains a supply of molten metal 28 whose surface is covered by a layer of slag as shown at 30 in FIG. 1. The interface 32 between the layer of slag 30 and the molten metal 28 is maintained due to the difference in the specific gravity between the slag layer and the molten metal. As discussed previously, so long as the level of fluid in the tundish remains above a critical level, designated by diagrammatically at 34 in FIG. 1, the swirl generated in the fluid as it is discharged through the collector nozzle does not create a vortex funnel having a suction effect which tends to draw the slag in the layer 30 down to the funnel into the nozzle for discharge with the molten metal. Thereafter, the vortex inhibiting body 40 according to the present invention can be placed into the bath of molten metal above the nozzle to inhibit the effect of the vortex at and below the critical level 34 within the tundish 12.

Figure 2:
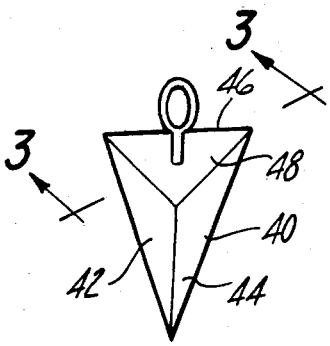
FIG. 2 is an enlarged perspective view of the vortex inhibitor shown in FIG. 1.

As best shown in FIG. 2, the vortex inhibiting body 40 of the present invention comprises a tetrahedral block made from a castable refractory material. In the preferred embodiment, the body 40 is in the shape of a regular tetrahedron so that the volume, and therefore the mass of the refractory is maximized, for a given size of the body 40. Moreover, the tetrahedral shape provides a maximum amount of planar surface area in contact with the fluid. As a result, the body 40 shown in the preferred embodiment as triangular shaped sides 42, 44, 46 and 48 having the same size. Since the height at which the vortex forms over the nozzle is dependent, at least in part on the nozzle diameter it is believed that the length of each side of a triangular face should be within the range of 1.15 to 2.25 times the pour diameter of the nozzle in order to most effectively obstruct the formation of the vortex funnel. For example, with a pour diameter of 55 mm, a critical level of approximately 500 mm would occur. Thus, a 110 mm side length for each triangular face is considered practical.

Figure 3:
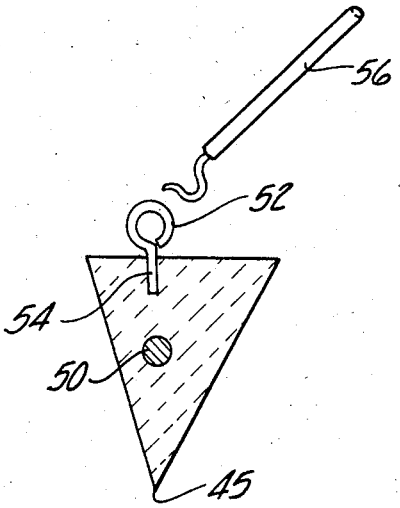
FIG. 3 is a sectional view of the inhibitor body taken substantially along the line 3—3 in FIG. 2.

Referring now to FIG. 3, the apex 45 at the intersection of the sides 42, 44, and 46 is weighted by a weighting sphere 50, whereby the center of gravity of the body 40 stabilizes the position of the body in the molten metal so that the apex 45 points downwardly when it floats in the metal. Such weighting and positioning of the apex 45 permits the body 40 to center itself within the swirl generated by the discharge of metal 28 through the nozzle 20 so that it is positioned at the center of the vortex created at the critical level.

Preferably, the body 40 also includes means for placing the body within the tundish. Such means can be conveniently provided by a handle means extending out of side 48 opposite the apex 45 so that the body is readily engaged by the hook of a placement rod or gaff 56 for insertion or removal from the tundish. As shown in FIG. 3, the handle means comprises a wire loop 52 having a stem 54 embedded within the refractory material body and the loop 52 remains accessible exteriorly of the body for engagement by gaff 56 or other implement for positioning the body from a location remote from the interior of the tundish.

It is to be understood that the overall specific gravity of the body having the weighting sphere 50 entrained therein is less than the specific gravity of the molten metal, and can be greater than the specific gravity of the slag layer 30. As a result, the body 40 intersects the interface 32 between the slag layer 30 and the molten metal to form a physical barrier obstructing the normally open funnel which is formed by the vortex and through which the suction effect causes the slag to flow downwardly toward the nozzle when the supply of metal is at the critical level 34. Moreover, the mass of the body provides inertia which creates an energy loss in the swirl generated by the discharge of metal through the nozzle and therefore inhibits formation of a vortex funnel and its associated suction effect at and below the critical level 34. Thus, while the body 40 tends to rotate with the swirl generated by discharge of the metal from the nozzle 20, the energy of the swirl of vortex is substantially less than is necessary to cause the suction which forces the slag to flow through the nozzle with the molten metal. As a result, the present invention substantially eliminates contamination through vortex action and substantially reduces the critical level at which a metal pouring step had heretofore been terminated, or the manufacturing process changed. Of course, it will be understood that when the supply of metal within the tundish 12 is above the critical level 34, the body 40 does not interfere with the normal full rate of flow through the collector nozzle 20.

Moreover, as the level of the molten metal continues to decrease below the previously known critical level, the apex 45 of the body 40 approaches the nozzle 20. Until it does, the full flow rate of the nozzle is not obstructed. As the apex 45 begins to enter the nozzle 20, a throttling effect substantially reduces the flow rate of molten metal through the nozzle 20. Of course, it will be understood that the polygonal shape of the cross-section of the tapered body governs the amount by which the nozzle opening is restricted. Thus, for example, a square based pyramid body provides a greater shutdown ratio than the tetrahedral body of the preferred embodiment, and an octagonal pyramid body effects a substantially greater shutdown ratio for the flow of molten metal through the nozzle. Thus, the plugging or throttling effect can be adjusted as desired for particular operations.

The throttling effect is detectable by observation of the flow of molten metal through the upper collector nozzle to the submerged entry nozzle by a worker, or it can be automatically sensed by sensing equipment connected in communication with flow passages through the nozzles. Regardless of how the throttling effect is sensed, the throttling effect provides an indication that the tundish has been substantially drained of high quality molten metal, and that the introduction of slag into the strand mold is becoming imminent. At this point, the control 26 can be actuated by the worker or automatically so that the run of high quality steel into the strand mold 14 is not contaminated by steel contaminated with slag.

Thus, the vortex inhibiting body 40 of the present invention is advantageous in that it permits the pouring of a high quality steel into another receptacle such as a strand mold at a maximum flow rate well below the previously known critical level at which contamination inevitably occured. Moreover, use of the vortex inhibiting body 40 also permits further drainage of the tundish at a lower flow rate when the apex of the body begins to enter the nozzle so that substantially the entire amount of high quality molten metal can be discharged from the tundish without contamination by the slag. As a result, it can be appreciated that a tundish can be operated more efficiently and that substantially less steel must be hardened and remelted between strand making operations. Moreover, the invention substantially reduces the amount of low quality steel which must be discharged from the tundish in order to empty the tundish. Moreover, when steel grade changes are to be made within the tundish for subsequent casting processes, the mixture zone heretofore known and compensated for can be substantially reduced.

Figure 4:
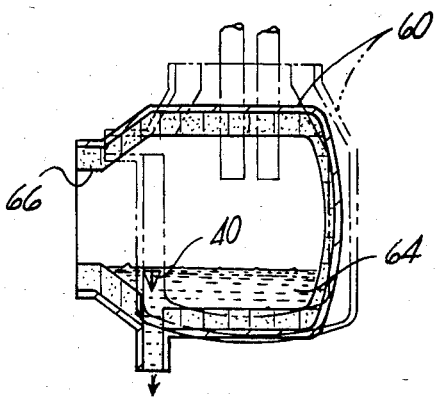
FIG. 4 is a sectional view of a furnace employing a vortex inhibitor according to the present invention.

In addition, although the present invention is especially useful for the operation of a tundish, it will be understood that the buoyant refractory body of the present invention is also useful for controlling the discharge of molten metal from other receptacles such as ladles or furnaces. As shown in FIG. 4, the body 40 according to the present invention can be employed in a furnace 60 having a discharge nozzle or tap hole 62 below the layer of molten metal 64 within the furnace 60. Such a furnace often includes an enlarged opening 66 for insertion of an oxygen lance when the furnace is pivoted to an upright position as shown in phantom line in FIG. 4 or it can have other heating means for melting the metal.

Figure 5:
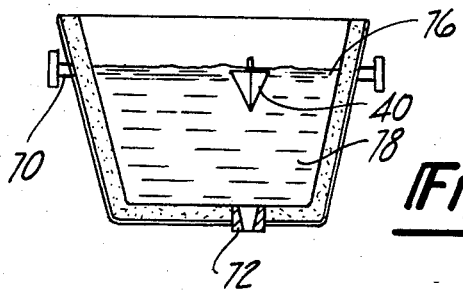
FIG. 5 is a sectional view of a metal making ladle employing a vortex inhibitor of the present invention.

As shown FIG. 5, the body 40 is shown positioned over the discharge nozzle 72 of a ladle 70 for transporting molten metal between receptacles such as the furnace and the tundish. As in a tundish, the slag as designated at layer 76 and molten metal as designated at 78 remain separated. Of course, it will be appreciated that substantially all of molten metal is discharged during each operation of the ladle and the furnace, and the primary purpose of refractory body 40 in these receptacles is to maintain the separation of the slag from the molten metal during discharge through the discharge nozzles or tap holes. Although the problem of hardening and remelting of the molten metal is not a problem with these devices, the energy absorption and the throttling effect advantages of the vortex inhibitor 40 permits a substantial amount of slag to be eliminated from metals being poured from these devices.

Having thus described my invention, many modifications thereto will become apparent to those skilled in the art to which is pertains without departing from the scope and spirit of the present invention as defined in the appended claims.

What is claimed is:

1. In combination with molten metal receptacles wherein a layer of slag covers a layer of molten metal and having a discharge nozzle beneath the level of molten metal, the improvement comprising;

means for inhibiting the suction generated by the vortex formed above the discharge nozzle to prevent mixture of the slag with the molten metal being discharged through said discharge nozzle, wherein said means comprises a polygonal body of refractory material tapered along its entire length and means for supporting said body at the interface of said layer of slag and layer of molten metal over said discharge nozzle whereby said body generally conforms with the shape of the vortex substantially along its entire length.

2. The invention as defined in claim 1 wherein said means for supporting comprises said body having a specific gravity less than the specific gravity of said molten metal and greater than the specific gravity of said slag.

3. The invention as defined in claim 1 wherein said body comprises a tetrahedral body of refractory material.

4. The invention as defined in claim 1 wherein said body includes weighting means for orienting the apex of said tapered body to extend downwardly into said layer of molten metal.

5. The invention as defined in claim 1 wherein said body is formed from a castable refractory material.

6. The invention as defined in claim 3 wherein said tetrahedral body is a regular tetrahedron.

7. The invention as defined in claim 1 wherein said receptacle comprises a ladle.

8. The invention as defined in claim 1 wherein said receptacle comprises a melting furnace.

9. The invention as defined in claim 1 wherein said receptacle is a tundish.

10. The invention as defined in claim 1 and further comprising means for placing said body in said receptacle.

11. The invention as defined in claim 10 wherein said placement means comprises handle means extending outwardly from the base of said tapered body for suspending said body.

12. The invention as defined in claim 11 wherein said handle means comprises a wire.

13. In combination with molten metal receptacles wherein a layer of slag covers a layer of molten metal and having a discharge nozzle beneath the level of molten metal, the improvement comprising;

means for inhibiting the suction generated by the vortex formed above the discharge nozzle to prevent mixture of the slag with the molten metal being discharged through said discharge nozzle wherein said means comprises a tapered, polygonal body of refractory material and means for supporting said body at the interface of said layer of slag and layer of molten metal over said discharge nozzle, and wherein said body includes weighting means for orienting the apex of said tapered body to extend downwardly into said layer of molten metal.

14. The invention as defined in claim 13 wherein said weighting means comprises a core of material with a greater specific gravity than the refractory material.

15. The invention as defined in claim 14 wherein said weighting core is spherical.

* * * * *

UNITED STATES PATENT AND TRADEMARK OFFICE

CERTIFICATE OF CORRECTION

PATENT NO. : 4,601,415

DATED : July 22, 1986

INVENTOR(S) : Robert J. Koffron

It is certified that error appears in the above-identified patent and that said Letters Patent is hereby corrected as shown below:

Column 2, Line 14, The word "affect" should be --effect--;

Column 2, Line 64, Delete "is";

Column 3, Line 64, After "part" insert --,--; and
After "diameter" insert --,--.

Signed and Sealed this

Twenty-eighth Day of October, 1986

[SEAL]

*Attest:*

DONALD J. QUIGG

*Attesting Officer* *Commissioner of Patents and Trademarks*